US005813255A

United States Patent [19]

Tell, III et al.

[11] Patent Number: 5,813,255

[45] Date of Patent: Sep. 29, 1998

[54] LOCK MECHANISM WITH CLOSED CASE CHANGEOVERS

[75] Inventors: William Tell, III, Lancaster; Samuel R. Weigard, Columbia, both of Pa.

[73] Assignee: PDQ Industries, Inc., Leola, Pa.

[21] Appl. No.: 719,998

[22] Filed: Sep. 25, 1996

[51] Int. Cl.[6] ..... E05B 59/00

[52] U.S. Cl. ..... 70/107; 70/110; 70/462; 70/467; 292/34; 292/37; 292/165; 292/169.15

[58] Field of Search ..... 70/107–111, 461, 70/462, 467–471, 486; 292/34, 37, 165, 169.14, 169.15, 244

[56] References Cited

U.S. PATENT DOCUMENTS

| | | | |
|---|---|---|---|
| 2,638,770 | 5/1953 | Gutman | 70/107 |
| 3,672,714 | 6/1972 | Schultz | 70/107 X |
| 3,769,822 | 11/1973 | Yulkowski | 70/107 |
| 3,808,849 | 5/1974 | Alexander | 70/107 X |
| 4,572,556 | 2/1986 | Foshee | 70/107 X |
| 4,583,382 | 4/1986 | Hull | 70/107 |
| 4,606,203 | 8/1986 | Esser | 70/107 |
| 4,870,841 | 10/1989 | Cudd | 70/107 |
| 4,950,005 | 8/1990 | Cudd | 70/107 X |
| 4,988,133 | 1/1991 | Shih | 292/244 X |
| 5,027,625 | 7/1991 | Krachten | 70/107 |
| 5,201,200 | 4/1993 | Hauber | 70/107 |
| 5,301,525 | 4/1994 | Doring | 70/107 |

*Primary Examiner*—LLoyd A. Gall
*Attorney, Agent, or Firm*—Martin Fruitman

[57] ABSTRACT

The invention is a mortise lock constructed for very simple conversion between multiple functions and left and right hand openings. The lock can include or omit retraction of the latch bolt from either side with a key, permanent locking of either side's retractor, removal of the stopworks, simultaneous retraction of the latchbolt and deadbolt, or locking the retractor when the deadbolt is thrown. All of these conversions are accomplished without opening the case cover by the insertion or removal of screws or parts through holes in the cover or case, with the screws either stopping a part from moving or providing a catch upon which a part acts. The changeover between right and left handed openings is accomplished through the backplate with removal of only the armor plate, by removing, reversing, and reinstalling the latchbolt.

2 Claims, 2 Drawing Sheets

LOCK MECHANISM WITH CLOSED CASE CHANGEOVERS

BACKGROUND OF THE INVENTION

This invention deals generally with locks and more specifically with a multiple function mortise lock in which the functions can be changed without opening the case.

The door locks we all use every day are actually much more complex than most people other than locksmiths realize. While most doors include an arrangement which permits the user to unlock the latchbolt and the deadbolt with one or two keys and also leave the latchbolt operable with the outside door lever without a key, there are actually many more function options which may be required of a lock.

For example, before a lock is actually installed in a door it must be arranged to operate correctly depending upon whether the door is a right or a left hand door. Another selection to be made is whether a stopworks is to be included in the lock. The stopworks is the device, usually a toggle type of mechanism operable through the faceplate on the edge of the door, which permits the user to lock or unlock the outside door lever.

Other options which can be available for a lock are the ability to retract the deadbolt with the rotation of the inner door lever, the ability to permanently lock the outside door lever, the ability to lock the outside door lever whenever the deadbolt is thrown, and the choice to retract or not retract the deadbolt with a key from the outside.

Previously, all such options were selected by removing the cover of the lock case assembly, removing parts from or installing parts into the case assembly, and then replacing the cover. However, such actions require special skills and significant time, and the choices of the options to be installed into locks must frequently be selected in the field. For example, a common situation in which multiple options must be available, but are usually selected as construction progresses, is a multiple room hotel. In such a project, guest rooms have both right hand and left hand doors, and storage rooms and public rooms have lock requirements that are different from those of guest rooms, yet it is economical to purchase all the locks at once before all the requirements may be firmed up. Furthermore, replacement locks of all varieties must be installed by maintenance personnel, and it is very burdensome to require different replacements to be available to match all possible lock permutations or to require that maintenance personnel open up locks to convert them to the proper options.

SUMMARY OF THE INVENTION

The present invention permits a single lock structure to fulfill all the requirements of all the various lock functions, while permitting the changeover between options to be performed without removing the lock assembly cover.

The invention is a mortise lock constructed for very simple conversion between multiple functions and simple change of lock handing between left hand, right hand, opening in and opening out. The lock can include or omit retraction of the latch bolt from either side with a key, permanent locking of either side's lever and retractor, removal of the stop works, simultaneous retraction of the latchbolt and deadbolt, or locking of the outside retractor when the deadbolt is thrown. All of these conversions are accomplished without removing the cover by the insertion or removal of several screws through the cover and the case, with the screws either stopping a part from moving or providing a catch upon which a part acts. The changeover between right and left handed openings is accomplished through the faceplate after removal of only the armor plate. One screw is removed through the cover, and the latchbolt is pulled through the faceplate and reversed before being reinstalled in the case assembly and being secured with the screw.

One option of the case assembly of the invention is the ability to retract or not retract the latchbolt with a key from either side of the door. This changeover is accomplished by either installing or removing the cylinder retractor arm, through a hole in the cover which is the same shape as the cylinder retractor arm. The cylinder retractor arm is held in place by a screw threaded into the standoff upon which the cylinder retractor arm pivots. When the cylinder retractor arm is installed, the latchbolt can be operated by a key from either side of the door.

Another option of the invention is to permanently lock the lever on either side of the door. This is done by inserting an awl or similar tool through a slot in the affected side of the case assembly and moving that side's lock lever to compress the associated lock spring. To hold the lock lever in that position against the force of the lock spring, a screw is inserted into a threaded hole on the same side of the case assembly. The screw then holds the lock lever in a position which interferes with the rotation of the retractor and the lever of that side of the door.

Two other options of the invention are to add or remove the stopworks from the lock assembly and to designate one side or the other of the door as the outside which is affected by the stopworks. The stopworks is the mechanical toggle which is located on the face of the lock case assembly, and is used to temporarily lock the lever on the designated outside of the door. In order to remove the stopworks a screw which holds the stopworks on its pivot pedestal is removed through a hole in the cover, and the stopworks is removed through the face of the lock case assembly. To install the stopworks, it is inserted through the face of the lock case assembly and its holding screw is inserted through its hole in the cover.

This process of removal and installation is also used for selection of the designated outside of the door. The stopworks is constructed as a symmetrical part except that its end lever which operates inside the case assembly is shaped so that it can contact only one of the two lock levers. Thus, reversing the stopworks changes the side of the door which it affects, and all that is required to reverse the stopworks is to remove it, turn it upside down, and reinstall it.

The invention is also able to activate or deactivate the retraction of the deadbolt along with the latchbolt from the designated inside of the door. This selection is accomplished by inserting a screw into the latchbolt assembly through a hole in the selected side of the lock case assembly. Then, when the latchbolt is retracted, this screw engages an egress lever which, in turn, engages a pin on the deadbolt assembly and withdraws the deadbolt. Since the lock has separate egress levers on the opposite sides of the case, this feature can be selected for either side of the door.

It is also possible to select one side of the door for which throwing the deadbolt locks the designated retractor which locks the lever. That is, when the deadbolt is extended by the occupant of the room, the outside door lever is automatically locked. This is accomplished by inserting a screw into the deadbolt assembly through a hole in the lock case assembly. When this is done and the deadbolt is extended, the screw engages the egress lever and rotates it. The egress lever also rotates the lock lever which engages the retractor and prevents it from rotating.

Another feature of the invention is the ability to reverse the "handing" of the lock assembly, that is, reversing the latch so that it operates with the door hinges on either edge of the door. This requires the reversing of the side of the latchbolt which has the bevel, so that the door will automatically latch when it is closed. To accomplish this a screw which holds the latchbolt is removed through a hole in the cover, and the latchbolt is removed through the faceplate at the door's edge. The latchbolt is then rotated 180 degrees, reinstalled, and the holding screw replaced through the hole in the cover.

Two other safety functions are permanently designed into the lock assembly of the invention to prevent forced entry. The first is a structure which prevents the deadbolt from being forcibly retracted by pushing on the deadbolt. This safety feature uses an over center linkage at the end of the deadbolt travel, so that any force against the deadbolt itself pushes the linkage against a stop pin to prevent retraction.

The other safety feature uses a guardbolt to prevent forcible retraction of the latchbolt. The guardbolt is retracted by its contact with the door's strike plate, and this action rotates a lever which acts as a stop to prevent the forcible retraction of the latch bolt.

As can be appreciated from the foregoing description, the invention furnishes an extremely versatile lock assembly, with a great many optional features, and the selection of and changeover to the various features never requires the opening of the lock case assembly.

DETAILED DESCRIPTION OF THE INVENTION

Figure 1:
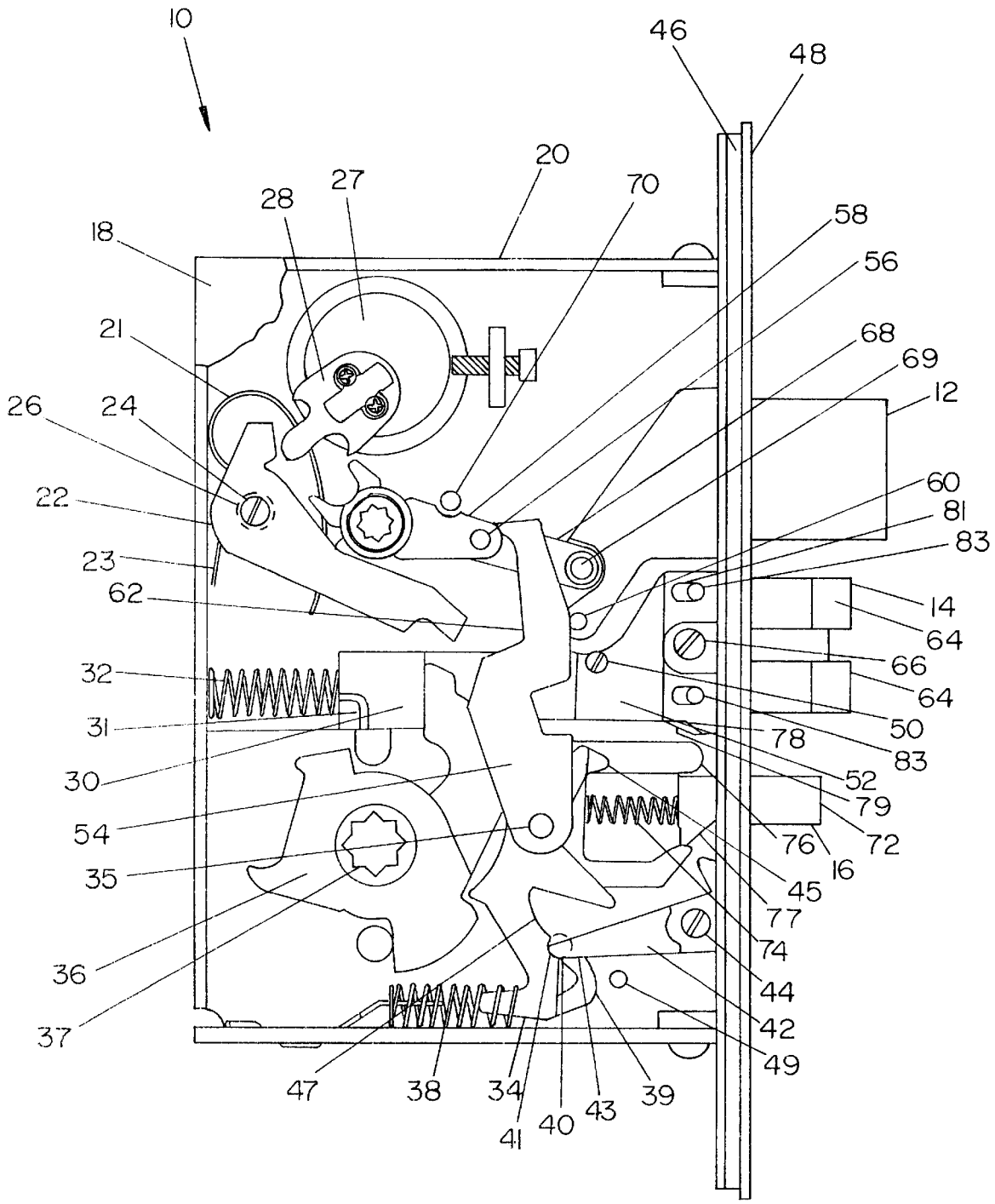
FIG. 1 is a side view of the lock structure of the preferred embodiment of the invention.
Figure 2:
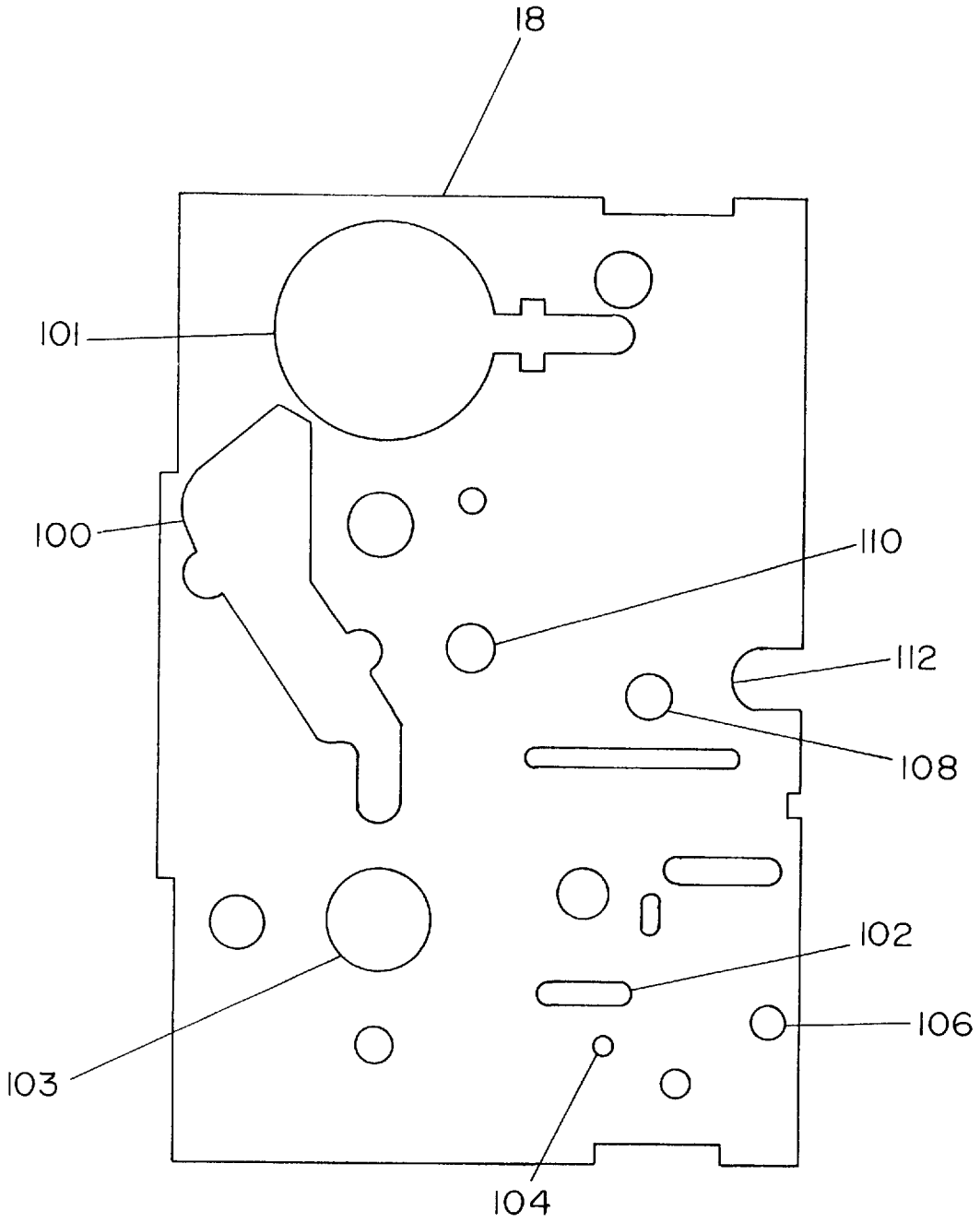
FIG. 2 is a view of the cover of the preferred embodiment of the invention showing the various holes through which the function changes are accomplished.

FIG. 1 is a side view of lock case assembly 10 of the preferred embodiment of the invention in which deadbolt 12, latchbolt assembly 14 and guardbolt 16 are all shown extended for clarity, and cover 18, which is shown in its entirety in FIG. 2, is shown cut away only in the upper left corner of case 20. FIG. 2 is a view of cover 18 of the invention showing the various holes through which the function changes are accomplished, and it should be kept in mind that almost all of the holes shown in FIG. 2 are duplicated on backside 20 of case assembly 10 of FIG. 1. In the lock industry the backside 20 of the case is referred to simply as "the case". The description of the invention which follows refers to both the components shown in FIG. 1 and the holes shown in FIG. 2.

Lock case assembly 10 can be set up to retract or not retract the latchbolt with a key from either side of the door. This changeover is accomplished by either installing or removing cylinder retractor arm 22, through hole 100 in cover 18. Hole 100 is approximately the same shape as cylinder retractor arm 22. Cylinder retractor arm 22 is held in place by screw 24 which is also accessible through hole 100 and is threaded into standoff 26 upon which cylinder retractor arm 22 pivots. Cylinder retractor arm 22 is also acted upon by spring 23.

When cylinder retractor arm 22 is installed, latchbolt 14 can be operated by a key from either side of the door, because rotating a key turns cylinder cam 28 attached to cylinder 27 which is installed through threaded hole 101. Cylinder cam 28 then rotates retractor arm 22 into contact with boss 31 on latchbolt stem 30 and retracts latchbolt assembly 14 while compressing latchbolt spring 32. With cylinder retractor arm 22 removed, a key within cylinder 27 has no interaction with latchbolt assembly 14.

The invention is also able to permanently lock the lever on either side of the door. The levers are installed into lock case assembly 10 by inserting a square shaft (not shown) to which a lever is attached through splined hole 37 in retractor 36. Retractor 36 rotates in hole 103. A lever is locked by using a rod type tool through slot 102 on the selected side of the case assembly and moving that side's lock lever 34 toward retractor 36 into the position shown on FIG.1, thus compressing the associated lock spring 38. To hold lock lever 34 in that position against the force of lock spring 38, screw 40 (shown with dashed lines) is threaded into hole 104 on the same side of the case, and screw 40 extends into the case assembly to hold lock lever 34, which pivots on standoff 35, in the position shown which interferes with the rotation of retractor 36. Retractor 36 is operated by the lever (not shown) of that side of the door, and since retractor 36 is rigidly connected to the lever, screw 40 thereby also locks the lever.

Screw 40 is actually shown in FIG. 1 as in the same location as end 43 of stopworks 42, but if one lever of the door is to be permanently locked, stopworks 42 would be removed. Another feature of the invention is that stopworks 42 can easily be added or removed from lock case assembly 10, and it can be reversed to designate one side or the other of the door as the outside which is affected by stopworks 42. Stopworks 42 is the mechanical toggle which is located on the face of the lock case assembly, and is used to temporarily lock the lever on the designated outside of the door. In order to remove stopworks 42, screw 44 on which stopworks 42 pivots is removed through hole 106 in cover 18, and stopworks 42 is removed through the faceplate 46 and armor plate 48. To install stopworks 42, it is inserted through faceplate 46 and armor plate 48 and its pivot screw 44 is inserted through hole 106.

This process of removal and installation is also used for selection of the designated outside of the door. The stopworks is constructed as a symmetrical part except that its end lever 43, which contacts lock lever 34, is thin and shaped so that it only contacts either lock lever 34 near cover 18 or similar lock lever 39 near the case, and therefore can contact only one of the two lock levers. Thus, reversing stopworks 42 changes the side of the door which it affects, and all that is required to reverse stopworks 42 is to remove it, turn it upside down, thus moving end lever 43 to the other side of the case assembly, and reinstall stopworks 42.

Stopworks 42 operates by being manually pivoted on screw 44. When stopworks 42 is rotated into the position shown in FIG. 1, end lever 43 fits into pocket 41 and pushes lock lever 34 against retractor 36, thus preventing retractor 36 from rotating. However, when stopworks 42 is rotated so that end lever 43 is rotated up it does not contact lock lever 34 at pocket 41. Under that condition, lock lever 34 is pushed away from retractor 36 by spring 38 and into contact with stop pin 49 so that retractor 36 rotates freely. Contact surface 47 of lock lever 34 is shaped so that end lever 43 of stopworks 42 contacts it, and end lever 43 rotates lock lever into its position to lock retractor 36 as end lever 43 is lowered.

The invention is also able to activate or deactivate the retraction of deadbolt 12 as latchbolt assembly 14 is being retracted by the lever on the designated inside of the door. This selection is accomplished by inserting screw 50 into latchbolt cover 52 through hole 108 in the selected side of the lock case assembly. Then, when latchbolt assembly 14 is retracted, screw 50 engages egress lever 54 which pivots on standoff 35, engaging turnpiece cam pin 56, and withdrawing deadbolt 12. Since lock case assembly 10 has separate egress levers 54 on the opposite sides of the case assembly, this feature can be selected for either side of the door.

It is also possible to select one side of the door for which throwing deadbolt 12 locks the door lever. That is, when deadbolt 12 is extended, the outside door lever is automatically locked. This is accomplished by inserting a screw into threaded hole 60 on deadbolt 12 through hole 110 in cover 18 or another hole (not shown) on the case. When this is done and deadbolt 12 is extended, the screw in hole 60 catches egress lever 54 at back edge 62 and rotates egress lever 54 forward in the clockwise direction as deadbolt 12 is extending. In this position, egress lever 54 engages a boss 45, which is a thicker section on lock lever 34, and rotates lock lever 34 which is on the same standoff 35. When lock lever 34 rotates clockwise, it engages retractor 36 and prevents it from moving, as previously described. However, when deadbolt 12 is retracted, the screw in hole 60 does not affect egress lever 54, and lock spring 38 disengages lock lever 34 from retractor 36. Since there is also an egress lever (not shown) and a hole (not shown) on the case side of the lock case assembly, this feature can be used to lock the retractor on either side of the lock case assembly.

The invention also makes it possible to reverse the "handing" of the lock assembly, that is, reversing the latchbolt so that it operates with the door hinges on either edge of the door, without opening the lock case assembly. This requires the reversing of the side of the latchbolt which has bevel 64, so that the door will automatically latch when it is closed. To accomplish the reversal, screw 66 which holds latchbolt assembly 14 is removed through hole 112 in cover 18, and latchbolt assembly 14 is removed through faceplate 46. Latchbolt assembly 14 is then rotated 180 degrees, reinstalled, and holding screw 66 replaced through hole 112.

Two safety features are permanently designed into lock case assembly 10 of the invention to prevent forced entry. The first is a structure which prevents deadbolt 12 from being forcibly retracted by pushing on it. This safety feature uses an over center linkage at turnpiece cam pin 56 between turnpiece cam 58 and deadbolt link 68 which is connected to deadbolt 12 at pin 69. At the end of the extension travel of deadbolt 12, the links move just over center, as shown in FIG. 1. In that position, any force pushing against deadbolt 12 to attempt to retract it pushes link 58 against stop pin 70 and prevents any further retraction. However, normal retraction of deadbolt 12, which involves turnpiece cam pin 56 being retracted by egress lever 54 or turnpiece cam 58, overcomes the over center condition and can retract deadbolt 12.

The other safety feature uses guardbolt 16 to prevent forcible retraction of latchbolt assembly 14 by pushing on it with some device such as a thin card. Guardbolt 16 is itself retracted by its contact with the door's strike plate because its front edge 72 is beveled to engage and be pushed back by the strike plate (not shown). The retraction of guard bolt 16 compresses guardbolt spring 74 which pushes against and rotates guard lever 76 counter clockwise as it rides down slope 77. As guard lever 76 rotates it engages stop surface 78 on latchbolt cover 52 and acts as a stop to prevent the forcible retraction of latch bolt assembly 14 when the door is closed.

However, when retractor 36 is used to withdraw latchbolt assembly 14 when opening the door, retractor 36 pulls latchbolt stem 30 and a slight movement occurs between latchbolt cover 52 and the balance of latchbolt assembly 14, with the movement limited by slots 81 and pins 83. This small movement pushes slope 79 against guard lever 76 and rotates guard lever 76 clockwise. With guard lever 76 moved out of the way, latchbolt assembly 14 can be fully withdrawn in normal fashion. Nevertheless, latchbolt assembly 14 can not be pushed back into lock case assembly 10 when guardbolt 16 is pushed flush with armorplate 48 if rotation of retractor 36 is not first initiated.

The invention thereby furnishes a very versatile lock assembly which can be modified for most necessary changes of function without ever opening the lock case assembly, and the invention also furnishes very desirable features which protect against forced entry.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, additional holes and slots are shown in FIG. 2 which serve conventional purposes in lock assembly case 10, such as acting as guides for the movement of deadbolt 12, latchbolt 14, and guardbolt 16.

What is claimed as new and for which Letters Patent of the United States are desired to be secured is:

1. In a lock assembly of the type in which a case encloses a latchbolt; a rotating retractor interconnected with the latchbolt, the retractor retracting the latchbolt when rotated by a manual lever; and a deadbolt which can be extended and retracted; the improvement comprising:

a deadbolt pin interconnected with the deadbolt so that moving the deadbolt pin moves the deadbolt;

a pivoting egress lever installed within the case which moves the pin to retract the deadbolt; and a screw which is installable and removable through a hole in the case, the screw, when installed, being interconnected with the latchbolt so that retraction of the latchbolt moves the screw into contact with the egress lever and pivots the egress lever so that the deadbolt is retracted with retraction of the latchbolt.

2. In a lock assembly of the type in which a case encloses a latchbolt; a rotating retractor interconnected with the latchbolt, the retractor retracting the latchbolt when rotated by a manual lever; and a pivoting lock lever which, when in a locking position, prevents the rotation of the retractor; the improvement comprising:

a deadbolt which can be extended and retracted installed within the case;

a pivoting egress lever installed within the case and interconnected with the pivoting lock lever so that the lock lever moves into the locking position when the egress lever moves in the same direction as the deadbolt moves when being extended; and a screw which is installable and removable through a hole in the case, the screw, when installed, being located on the deadbolt so that extension of the deadbolt moves the screw into contact with the egress lever and pivots the egress lever and the lock lever so that the retractor is locked with extension of the deadbolt.

* * * * *